US009181815B2

(12) United States Patent
Grover

(10) Patent No.: US 9,181,815 B2
(45) Date of Patent: Nov. 10, 2015

(54) SHAPED RIM CAVITY WING SURFACE

(75) Inventor: Eric A. Grover, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 704 days.

(21) Appl. No.: 13/462,150

(22) Filed: May 2, 2012

(65) Prior Publication Data

US 2013/0294897 A1 Nov. 7, 2013

(51) Int. Cl.
*F01D 11/00* (2006.01)

(52) U.S. Cl.
CPC ..... *F01D 11/001* (2013.01)

(58) Field of Classification Search
CPC ..... F01D 11/00; F01D 11/001; F01D 11/02; F01D 11/005; F01D 11/008; F01D 4/04; F01D 4/06
USPC ..... 415/115–116, 182.1, 183, 185, 191, 415/173.7, 174.5, 170.1, 216.1; 416/193 A, 416/248
See application file for complete search history.

(56) References Cited

U.S. PATENT DOCUMENTS

| | | | | |
|---|---|---|---|---|
| 6,077,035 | A | 6/2000 | Walters et al. | |
| 6,506,016 | B1 * | 1/2003 | Wang | 415/173.7 |
| 6,837,676 | B2 * | 1/2005 | Yuri et al. | 415/115 |
| 7,465,152 | B2 | 12/2008 | Nigmatulin | |
| 7,540,709 | B1 | 6/2009 | Ebert | |
| 7,578,653 | B2 | 8/2009 | Klasing et al. | |
| 7,967,559 | B2 | 6/2011 | Bunker | |
| 8,016,552 | B2 | 9/2011 | Bunker | |
| 8,016,553 | B1 | 9/2011 | Liang | |
| 8,075,256 | B2 | 12/2011 | Little | |
| 2007/0059163 | A1 | 3/2007 | Tiemann | |
| 2007/0098545 | A1 * | 5/2007 | Alvanos et al. | 415/170.1 |

OTHER PUBLICATIONS

International Search Report and Written Opinion dated Sep. 25, 2013 from PCT Serial No. PCT/US2013/039261, twelve pages.

* cited by examiner

*Primary Examiner* — Edward Look
*Assistant Examiner* — Christopher J Hargitt
(74) *Attorney, Agent, or Firm* — Kinney & Lange, P.A.

(57) ABSTRACT

A shaped rim cavity wing includes an upper surface and a lower surface. The lower surface has a geometric shape to control the separation of airflow as it passes around the lower surface to the top surface. A point of maximum extent defines the boundary between the upper surface and the lower surface, wherein the point of maximum extent defines a corner that that separates airflow from the shaped rim cavity rim and creates a flow re-circulation adjacent to the top surface of the shaped rim cavity wing.

5 Claims, 4 Drawing Sheets

SHAPED RIM CAVITY WING SURFACE

BACKGROUND

The present invention is related to rim cavity wings, and in particular to shaped rim cavity wing surfaces.

The rim cavity region in turbomachinery applications refers to regions between rotating components and stationary components located interior of the gas path. Rim cavity regions pose a number of challenges that affect the overall performance of the turbomachinery equipment. For example, in the turbine section of a turbomachine, in which hot gas from the combustor progresses through the turbine flow path, the rim cavity region is cooled through the introduction of purge air into the rim cavity region. However, purge air (also referred to as bleed air) comes at the expense of overall engine efficiency.

In the compressor section of a turbomachine, in which air is compressed for delivery to the combustor section, the rim cavity region is typically pressurized to prevent high-pressure air from the gas path from escaping into the cavity region. Like purge air, high pressure air that escapes the gas path results in inefficiencies in the turbomachine.

SUMMARY

To prevent air from the rim cavity region from escaping into the gas path, either in the turbine section or the compressor section, wing seals extend from either the rotating or stationary components within the rim cavity to decrease or prevent the flow of air from the gas path to the rim cavity region and vice versa.

A shaped rim cavity wing includes an upper surface and a lower surface. The lower surface has a geometric shape to control the separation of airflow as it passes around the lower surface to the upper surface. A point of maximum extent defines the boundary between the upper surface and the lower surface, wherein the point of maximum extent defines a corner that separates airflow from the shaped rim cavity wing and creates a flow re-circulation adjacent to the upper surface of the shaped rim cavity wing.

DETAILED DESCRIPTION

Figure 1:
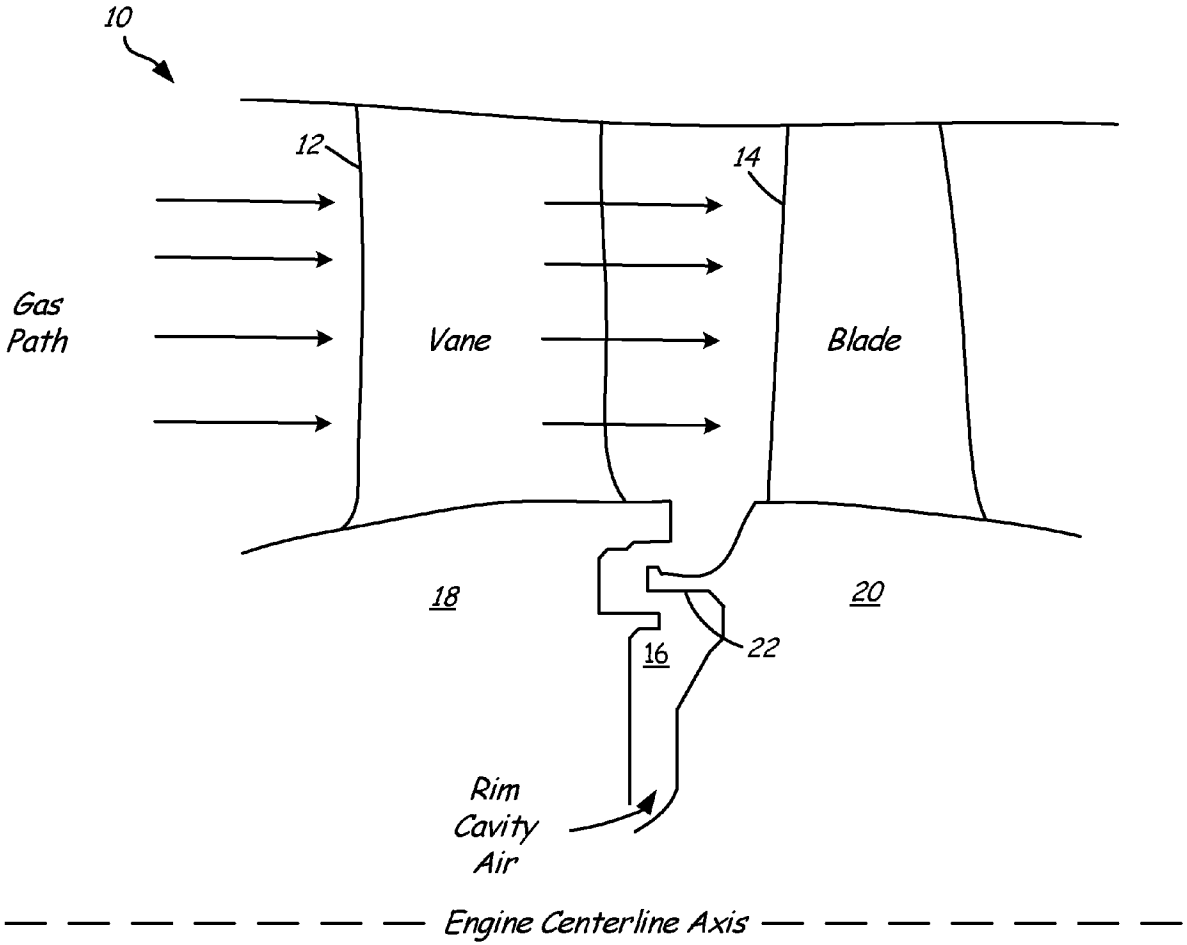
FIG. 1 is a cross-sectional view of a turbine section of a gas turbine engine employing shaped rim cavity wings according to an embodiment of the present invention.

FIG. 1 is a side view of turbine section 10 of a gas turbine engine employing shaped rim cavity wings according to an embodiment of the present invention. Turbine section 10 includes a plurality of stationary vanes 12 and a plurality of rotating blades 14. In the embodiment shown in FIG. 1, expanding hot gases provided by the combustor (not shown) flow axially from vanes 12 to blades 14.

Rim cavity 16 is located between stationary portion 18 (associated with the plurality of stationary vanes 12) and rotating disk 20 for attachment to the plurality of blades 14. In turbine section 10, cooling airflow is provided to rim cavity 16 to prevent overheating and damage to stationary portion 18 and rotating disk 20. In the embodiment shown in FIG. 1, shaped rim cavity wing 22 extends from rotating disk 20 into rim cavity region 16. In other embodiments, shaped rim cavity wing 22 would extend from stationary portion 18 into rim cavity region 16. The purpose of shaped rim cavity wing 22 is to prevent hot gas ingestion from the main gas path and/or to reduce purge flow requirements.

Shaped rim cavity wings 22 are employed in high pressure and low pressure turbine sections, as well as both high and low pressure compressor sections. In each case, shaped rim cavity wings 22 are employed as a seal between rotating and stationary components to prevent hot gas ingestion from the main gas path and/or to reduce purge flow requirements.

Figure 2A:
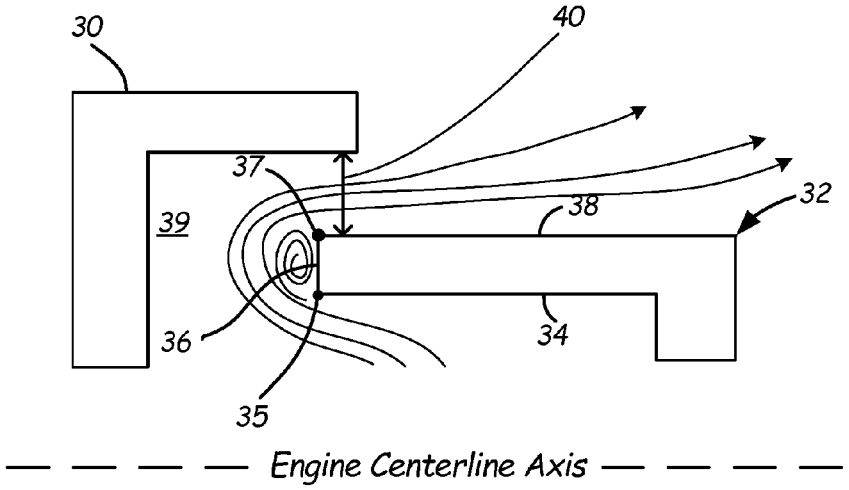
Fig. 2A PRIOR ART
FIG. 2A is a cross-sectional view of a rim cavity wing as known in the prior art.

FIG. 2A is a side view of rim cavity wing 32 as known in the prior art. In the embodiment shown in FIG. 2A, stationary portion 30 is located adjacent, but not in physical contact with, rim cavity wing 32. The geometry of rim cavity wing 32 is defined by lower surface 34, first corner 35, side surface 36, second corner 37, and upper surface 38. Rim cavity region 39 is maintained at a pressure higher than that of the gas path, resulting in air flowing from rim cavity region 39 into the gas path. The cross-sectional view shown in FIG. 2A illustrates the resulting flow of air from rim cavity region 39 to the gas path. The distance between stationary portion 30 and upper surface 38 of rim cavity wing 32 defines an effective leakage gap 40, the size of which relates to the sealing efficiency of rim cavity wing 32.

In the prior art rim cavity wing 32, the flow of air around first corner 35 results in a separation of the airflow from side surface 36, resulting in a flow re-circulation path that extends from side surface 36.

Figure 2B:
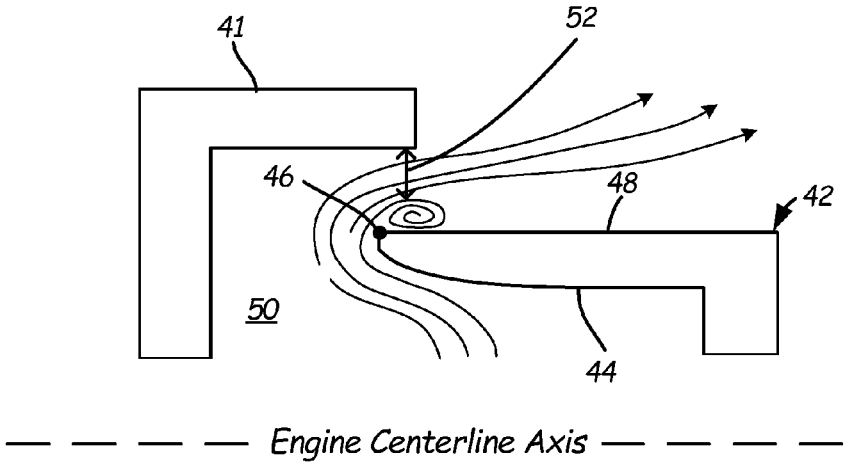
FIG. 2B is a cross-sectional view of a shaped rim cavity wing according to an embodiment of the present invention.

FIG. 2B is a side view of rim cavity wing 42 according to an embodiment of the present invention. In the embodiment shown in FIG. 2B, stationary portion 41 is located adjacent, but not in physical contact with, shaped rim cavity wing 42. The geometry of rim cavity wing 42 is defined by lower surface 44, point of maximum extent 46, and upper surface 48. Rim cavity region 50 is maintained at a higher pressure than the gas flowpath, and therefore, air flows from rim cavity region 50 into the gas path.

In the embodiment shown in FIG. 2B, the geometric shape of lower surface 44 of shaped rim cavity wing 42 is curved to control separation of the airflow along lower surface 44. Point of maximum extent 46, in contrast, is not curved and provides a sharp edge intended to separate airflow from upper surface 48 of shaped rim cavity wing 42. As a result of the flow separation created by point of maximum extent 46, a flow recirculation path is created adjacent to upper surface 48 between shaped rim cavity 42 and stationary component 41. The location of the flow re-circulation reduces the effective leakage gap 52 to a distance less than the actual distance between shaped rim cavity 42 and stationary component 41. The decrease in the effective leakage gap 52 improves the sealing efficiency of shaped rim cavity wing in preventing airflow from rim cavity region 50 into the gas path.

Figure 3:
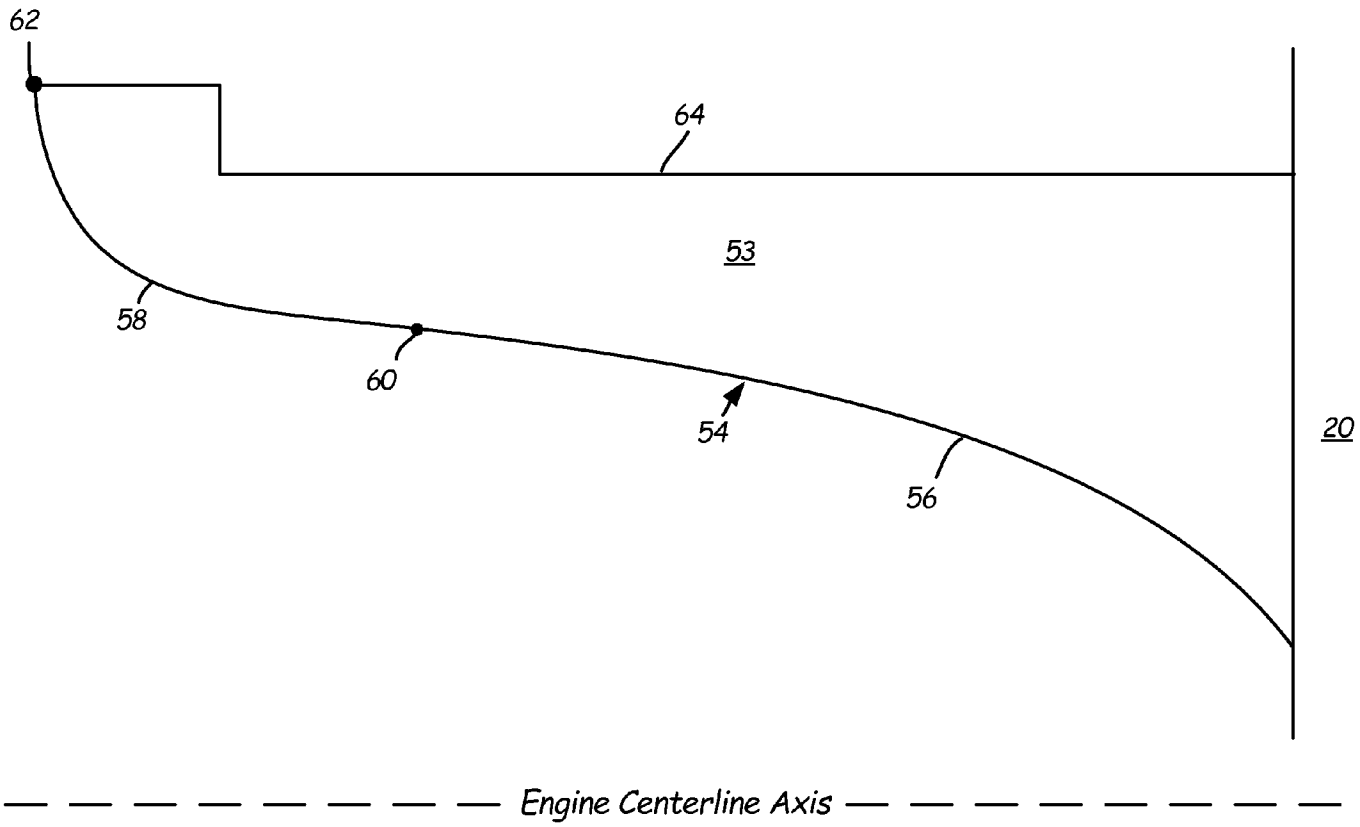
FIG. 3 is a cross-sectional view of a shaped rim cavity wing according to an embodiment of the present invention.

FIG. 3 is a side view of shaped rim cavity wing 53 according to an embodiment of the present invention. The geometry of shaped rim cavity wing 53 includes lower surface 54, point of maximum extent 62, and upper surface 64. In the embodiment shown in FIG. 3, lower surface 54 includes concave portion 56, convex portion 58, and point of inflection 60 located between the concave portion 56 and convex portion 58. In the embodiment shown in FIG. 3, the term 'concave' means curved inward toward shaped rim cavity wing 53. With respect to the engine centerline axis, concave portion 56 curves away from the engine centerline axis. The term 'convex' means curved outward away from shaped rim cavity wing 53. With respect to the engine centerline axis, convex portion 58 curves towards the engine centerline axis. In other embodiments, more than one point of inflection is included along lower surface 54, resulting in more than one concave portion and more than one convex portion. In the embodiment shown in FIG. 3, convex portion 58 is located adjacent to point of maximum extent 62, while concave portion 56 is located adjacent to rotating disk 20.

The placement of concave portion 56 and convex portion control the airflow along lower surface 54 to prevent separation of the airflow from lower surface 54. Rather, the airflow remains attached with lower surface 54 until reaching the point of maximum extent, at which point the airflow separates from shaped rim cavity wing 53 and creates the desired flow re-circulation between shaped rim cavity wing 53 and adjacent stationary portion (not shown in this view). In the embodiment shown in FIG. 3, a ninety-degree corner is provided at the point of maximum extent 62, for purposes of separating the airflow from rim cavity wing 53. In other embodiments, however, geometries other than a right angle (90° turn) may be employed to cause the desired separation of airflow from rim cavity wing 53.

Figure 4:
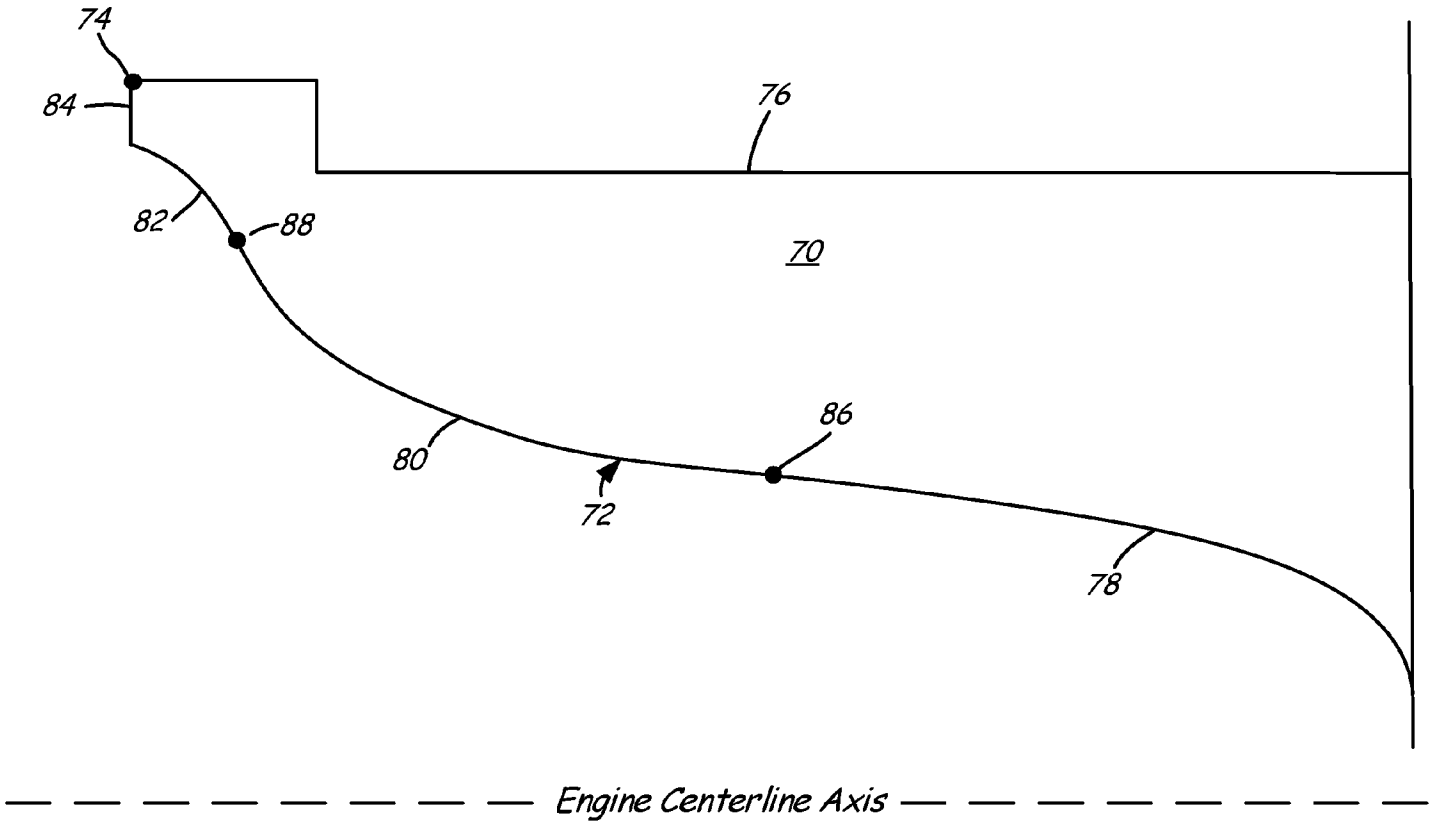
FIG. 4 is a cross-sectional view of a shaped rim cavity wing according to an embodiment of the present invention.

FIG. 4 is a side view of shaped rim cavity wing 70 according to another embodiment of the present invention. The geometry of shaped rim cavity wing 70 includes lower surface 72, point of maximum extent 74, and upper surface 76. In the embodiment shown in FIG. 4, lower surface 72 includes first concave portion 78, convex portion 80, second concave portion 82, vertical portion 84, first point of inflection 86 located between the first concave portion 78 and convex portion 80, and second point of inflection 88 located between convex portion 80 and concave portion 82. In the embodiment shown in FIG. 4, vertical portion 84 is located adjacent to point of maximum extent 74. Vertical portion 84 results in a discontinuity in the curvature of lower surface 72. However, the length of vertical portion 84 is selected so as to prevent separation of airflow until the airflow reaches point of maximum extent 74, resulting in the desired recirculation path adjacent to upper surface 76 of shaped rim cavity wing 70.

In the embodiment shown in FIG. 4, lower surface 72 includes two points of inflection, with first point of inflection 86 being located between concave portion 78 and convex portion 80, and second point of inflection 88 being located between convex portion 80 and concave portion 82. In other embodiments, additional points of inflection may be included with additional concave and convex portions depending on the desired flow characteristics.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbomachine comprising:
- a stationary portion;
- a rotating portion;
- a rim cavity region defined between the stationary portion and the rotating portion; and
- a shaped rim cavity wing extending from either the stationary portion or the rotating portion into the rim cavity region, the shaped rim cavity wing including:
  - an upper surface;
  - a lower surface having a geometric shape to control separation of airflow as it passes around the lower surface to the top surface, the geometric shape including:
    - a first concave portion;
    - a convex portion adjacent the first concave portion;
    - a first inflection point between the convex portion and the first concave portion;
    - a second concave portion adjacent the convex portion; and
    - a second inflection point between the second concave portion and the convex portion; and
  - a point of maximum extent that defines a boundary between the upper surface and the lower surface, wherein the point of maximum extent defines a corner that separates airflow from the shaped rim cavity wing and creates flow re-circulation adjacent to the upper surface of the shaped rim cavity wing;
  - wherein the first concave portion is located adjacent the point of maximum extent.

2. The turbomachine of claim 1, further including:
- a flat portion located between the point of maximum extent and the lower surface.

3. The turbomachine of claim 2, wherein the flat portion is vertical.

4. The turbomachine of claim 1, wherein the stationary portion and the rotating portion are located within a turbine section of the turbomachine.

5. The turbomachine of claim 1, wherein the stationary portion and the rotating portion are located within a compressor section of the turbomachine.

* * * * *